US011826291B2

(12) United States Patent
Jähkel

(10) Patent No.: US 11,826,291 B2
(45) Date of Patent: Nov. 28, 2023

(54) MOBILITY DEVICE

(71) Applicant: PERMOBIL AB, Timrå (SE)

(72) Inventor: Jonas Jähkel, Stockholm (SE)

(73) Assignee: PERMOBIL AB, Timrå (SE)

( * ) Notice: Subject to any disclaimer, the term of this patent is extended or adjusted under 35 U.S.C. 154(b) by 73 days.

(21) Appl. No.: 15/733,873

(22) PCT Filed: Jul. 18, 2019

(86) PCT No.: PCT/EP2019/069373
§ 371 (c)(1),
(2) Date: Nov. 30, 2020

(87) PCT Pub. No.: WO2020/016358
PCT Pub. Date: Jan. 23, 2020

(65) Prior Publication Data

US 2021/0220195 A1 Jul. 22, 2021

(30) Foreign Application Priority Data

Jul. 19, 2018 (EP) ..... 18184460

(51) Int. Cl.
*A61G 5/04* (2013.01)
*A61G 5/10* (2006.01)
*A61G 5/14* (2006.01)

(52) U.S. Cl.
CPC ..... *A61G 5/042* (2013.01); *A61G 5/1067* (2013.01); *A61G 5/1078* (2016.11); *A61G 5/14* (2013.01)

(58) Field of Classification Search
CPC .... A61G 5/042; A61G 5/1067; A61G 5/1078; A61G 5/14; A61G 5/128; A61G 5/1056;
(Continued)

(56) References Cited

U.S. PATENT DOCUMENTS 4,456,086 A 6/1984 Wier et al.
5,011,175 A * 4/1991 Nicholson ..... A61G 5/1059 280/650

(Continued)

FOREIGN PATENT DOCUMENTS

CA 2083042 A1 11/1991
CN 103356345 A 10/2013

(Continued)

OTHER PUBLICATIONS

Australian Patent Office Examination Report No. 1 for Application No. 2019304042 dated Jun. 18, 2021 (2 pages).

(Continued)

*Primary Examiner* — Steve Clemmons

(74) *Attorney, Agent, or Firm* — Michael Best & Friedrich LLP

(57) ABSTRACT

A mobility device (1) comprising: a main frame (3), drive wheel swing arms (5) pivotally connected to the main frame (3), drive wheels (7) connected to a respective one of the drive wheel swing arms (5), wheel motors, each wheel motor being configured to drive a respective drive wheel (7), a rear wheel swing arm (9) pivotally connected to the main frame (3), a rear wheel (11) connected to the rear wheel swing arm (9), and an actuating device configured to control a rear wheel swing arm angle between the rear wheel swing arm (9) and the main frame (3) independently of control of the wheel motors.

20 Claims, 4 Drawing Sheets

(58) Field of Classification Search
CPC .... A61G 5/122; A61G 5/124; A61G 2200/34; A61G 2203/10; A61G 2203/42; A61G 2203/70; B62D 61/00; B62D 17/00; B60G 7/006; B60G 17/0525; B60G 2200/464; B60G 2202/42; B60G 2202/422
See application file for complete search history.

(56) References Cited

U.S. PATENT DOCUMENTS

| | | | | | |
|---|---|---|---|---|---|
| 5,046,571 | A * | 9/1991 | Kullerud | A61G 5/1059 | 280/657 |
| 5,297,021 | A * | 3/1994 | Koerlin | A61G 5/12 | 297/354.12 |
| 5,515,934 | A * | 5/1996 | Davis | B62D 57/024 | 901/50 |
| 5,701,965 | A | 12/1997 | Kamen et al. | | |
| 5,975,225 | A * | 11/1999 | Kamen | A61G 5/068 | 180/21 |
| 6,112,843 | A * | 9/2000 | Wilcox | B60K 17/36 | 180/209 |
| 6,311,795 | B1 * | 11/2001 | Skotnikov | B60G 17/0152 | 280/6.154 |
| 7,004,271 | B1 * | 2/2006 | Kamen | B62K 1/00 | 180/21 |
| 7,419,176 | B2 | 9/2008 | Perk | | |
| 7,426,970 | B2 * | 9/2008 | Olsen | B60K 7/0007 | 180/908 |
| 7,717,200 | B2 * | 5/2010 | Kakinuma | B62D 61/00 | 180/218 |
| 7,766,106 | B2 * | 8/2010 | Puskar-Pasewicz | A61G 5/1078 | 180/907 |
| 7,784,815 | B2 | 8/2010 | Porcheron | | |
| 8,474,848 | B2 * | 7/2013 | Bernatsky | A61G 5/1075 | 280/250.1 |
| 8,596,719 | B2 * | 12/2013 | Engman | A61G 5/12 | 297/343 |
| 9,173,792 | B2 * | 11/2015 | Goffer | A61G 5/128 | |
| 9,278,036 | B2 * | 3/2016 | Lee | A61G 5/14 | |
| 9,375,372 | B2 | 6/2016 | Hunziker | | |
| 9,452,096 | B2 * | 9/2016 | Jahkel | A61G 5/1059 | |
| 9,511,811 | B2 * | 12/2016 | Andreev | B60G 17/0165 | |
| 10,028,870 | B2 * | 7/2018 | Olsson | A61G 5/1089 | |
| 10,719,085 | B2 | 7/2020 | Perkins | | |
| 10,772,774 | B2 * | 9/2020 | Richter | A61G 5/041 | |
| 2002/0121394 | A1 * | 9/2002 | Kamen | A61G 5/061 | 180/41 |
| 2004/0262055 | A1 | 12/2004 | Bancroft | | |
| 2007/0095582 | A1 | 5/2007 | Stuijt et al. | | |
| 2007/0102615 | A1 * | 5/2007 | Engman | A61G 5/128 | 248/371 |
| 2007/0152427 | A1 * | 7/2007 | Olsen | B60L 15/20 | 280/649 |
| 2009/0267315 | A1 | 10/2009 | Suddaby et al. | | |
| 2013/0278032 | A1 | 10/2013 | Hunziker | | |
| 2015/0053490 | A1 | 2/2015 | Santagata | | |
| 2017/0071804 | A1 * | 3/2017 | Olsson | A61G 5/125 | |
| 2019/0046373 | A1 * | 2/2019 | Coulter | H04L 9/0841 | |

FOREIGN PATENT DOCUMENTS

| | | | | |
|---|---|---|---|---|
| CN | 107049631 | A | 8/2017 | |
| CN | 107361934 | A | 11/2017 | |
| CN | 107595502 | A | 1/2018 | |
| CN | 206852718 | U | 1/2018 | |
| CN | 107696914 | A | 2/2018 | |
| DE | 19933052 | C1 * | 11/2000 | A61G 5/042 |
| DE | 19933053 | A1 | 2/2001 | |
| DE | 202007018454 | U1 | 7/2008 | |
| EP | 1738734 | A2 * | 1/2007 | A61G 5/061 |
| EP | 1997466 | A2 | 12/2008 | |
| EP | 3245994 | A1 * | 11/2017 | A61G 5/1059 |
| FR | 3066692 | A3 * | 11/2018 | B60B 35/10 |
| GB | 2548917 | A | 10/2017 | |
| JP | 2004275486 | A | 10/2004 | |
| JP | 2016189967 | A | 11/2016 | |
| WO | WO-9728775 | A1 * | 8/1997 | A61G 5/023 |
| WO | 9744206 | A1 | 11/1997 | |
| WO | WO-9744206 | A1 * | 11/1997 | A61G 5/06 |
| WO | 2016181173 | A1 | 11/2016 | |
| WO | 2017201513 | A1 | 11/2017 | |

OTHER PUBLICATIONS

International Search Report and Written Opinion for Application No. PCT/EP2019/069373 dated Oct. 7, 2019 (14 pages).
International Search Report and Written Opinion for Application No. PCT/EP2019/069375 dated Oct. 18, 2019 (12 pages).
International Preliminary Report on Patentability for Application No. PCT/EP2019/069373 dated Jun. 19, 2020 (12 pages).
International Search Report and Written Opinion for Application No. PCT/EP2019/069376 dated Oct. 1, 2019 (13 pages).
International Preliminary Report on Patentability for Application No. PCT/EP2019/069375 dated Jan. 19, 2021 (6 pages).
China National Intellectual Property Administration First Office Action for Application No. 201980039751.5 dated Jul. 1, 2022 (17 pages including English translation).
Taiwanese Patent Office Action for Related Application No. 108125454 dated Jan. 5, 2023 (9 pages, including an English statement of relevance).
Chinese Patent Office Action for Related Application No. 201980039751.5 dated Feb. 18, 2023 (15 pages, including an English translation).
Chinese Patent Office Action for Related Application No. 201980040358.8 dated Feb. 18, 2023 (16 pages, including an English translation).
Taiwanese Patent Office Decision of Rejection for Related Application No. 108125454 dated May 4, 2023 (8 pages, including an English translation).

* cited by examiner

MOBILITY DEVICE

CROSS REFERENCE TO RELATED APPLICATIONS

This application is a national phase filing of International Patent Application No. PCT/EP2019/069373, entitled "MOBILITY DEVICE" and filed on Jul. 18, 2019, which claims priority to European Patent Application No. 18184460.6 entitled "MOBILITY DEVICE" and filed on Jul. 19, 2018, the entire contents of each application is herein incorporated by reference in its entirety.

TECHNICAL FIELD

The present disclosure generally relates to mobility devices.

BACKGROUND

There have recently been presented new approaches in mobility device design. One such example is disclosed in WO2017201513. This document discloses a powered balancing mobility device that can provide the user the ability to safely navigate expected environments of daily living including the ability to manoeuvre in confined spaces and to climb curbs, stairs, and other obstacles, and to travel safely and comfortably in vehicles. The mobility device can provide elevated, balanced travel.

One drawback with the design disclosed in WO2017201513 is that it is relatively bulky. The mobility device hence has a relatively large footprint. Additionally, the solution is very complex due to its focus on balancing and stair climbing capability. The balancing aspect is furthermore a risk factor for users with disabilities.

Another mobility device is disclosed in WO2016/181173. The geometry of the wheelchair may be altered due to relative rotation of two independently powered wheel pairs. One drawback with this solution is that in case the position of the wheel pairs is to be changed during driving, the driving may be affected.

SUMMARY

In view of the above, a general object of the present disclosure is to provide a mobility device which solves or at least mitigates the problems of the prior art.

There is hence provided a mobility device comprising: a main frame, drive wheel swing arms pivotally connected to the main frame, drive wheels connected to a respective one of the drive wheel swing arms, wheel motors, each wheel motor being configured to drive a respective drive wheel, a rear wheel swing arm pivotally connected to the main frame, a rear wheel connected to the rear wheel swing arm, and an actuating device configured to control a rear wheel swing arm angle between the rear wheel swing arm and the main frame independently of control of the wheel motors.

The footprint of the mobility device may thereby be greatly reduced, depending on the rear wheel swing arm angle. In particular, the rear wheel swing arm angle determines the distance between the rear wheel axle of the rear wheel and the drive wheel axles of the drive wheels.

By controlling the rear wheel swing arm angle, the rear wheel swing arm and the drive wheel swing arms may be positioned in a range from the rear wheel being in close proximity with the drive wheels to being as far away as allowed by the rear wheel swing arm and the drive wheel swing arm.

The pivot connections between the drive wheel swing arms and the main frame may be spaced apart from the pivot connection between the rear wheel swing arm and the main frame.

The mobility device may be a mobility device for disabled users.

The mobility device may be a mobility vehicle, for example a mobility vehicle for disabled users.

The mobility device may be a wheelchair or mobility aid device. The mobility device may be a personal transporter or a personal mobility device.

According to one embodiment the actuating device is configured to adjust the rear wheel swing arm angle by pivoting the rear wheel swing arm relative to the main frame, thereby adjusting a distance between a rear wheel axle of the rear wheel and drive wheel axles of the drive wheels.

One embodiment comprises a body support system pivotally connected to the main frame. The body support system may be a body support assembly, a body support structure or a body support.

The body support system is configured to support the body of a user.

According to one embodiment the body support system comprises a lower body support system.

The lower body support system may be a lower body support assembly, a lower body support structure or a lower body support.

The lower body support system may comprise an elongated medial body support member pivotally connected to the main frame and which forms the pivot connection between the main frame and the body support system. The central longitudinal axis of the medial body support member may coincide with the median plane, i.e. the mid-sagittal plane, of the mobility device.

Due to the elongated shape of the medial body support member, the lower body support system may according to one example comprise a saddle seat arranged on the medial body support member.

According to one embodiment the body support system comprises an upper body support system pivotally connected to the lower body support system.

The upper body support system may be an upper body support assembly, an upper body support structure or an upper body support.

One embodiment comprises an actuator pivotally connected to the body support system and pivotally connected to the main frame, wherein the actuator is configured to control a body support system angle between the main frame and the body support system.

The combined centre of gravity of the mobility device and the user may thereby be changed without tilting the user. This is not the case for any mobility device on the market today.

According to one embodiment the actuator is configured to adjust the body support system angle by pivoting the body support system relative to the main frame.

One embodiment comprises inertial sensors and a control system, wherein the control system is configured to control the actuating device and thereby the rear wheel swing arm angle based on measurements by the inertial sensors.

The inertial sensors may for example include an accelerometer and a gyroscope.

The inertial sensors may be arranged on or inside the main frame.

According to one embodiment the control system is configured to control the actuator to adjust the body support system angle based on the measurements by the inertial sensors.

According to one embodiment the control system is configured to determine a current rear wheel swing arm angle and a current body support system angle, and to obtain a corresponding centre of gravity of the mobility device, and wherein the control system is configured to determine the centre of gravity of the combination of the mobility device and the mobility device user based on the centre of gravity of the mobility device and on the measurements by the inertial sensors, and to adjust the rear wheel swing arm angle and/or the body support system angle based on the centre of gravity of the combination of the mobility device and a mobility device user to obtain an adjusted centre of gravity of the combination of the mobility device and the mobility device user for stability.

According to one embodiment the control system stores all possible combinations of the rear wheel swing arm angle and the body support system angle and the corresponding centre of gravity of the mobility device.

According to one embodiment the main frame is an elongated structure. The main frame may have a central longitudinal axis which coincides with the median plane of the mobility device.

According to one embodiment the main frame has a first end portion to which the body support system is pivotally connected to the main frame and a second end portion to which the rear wheel swing arm is pivotally connected to the main frame.

According to one embodiment the drive wheels are front wheels and wherein the drive wheel swing arms are front swing arms. Alternatively, the drive wheels could be mid-wheel drive wheels and the drive wheel swing arms would then be mid-wheel swing arms.

According to one embodiment the actuating device is configured to control only the pivot motion of the rear wheel swing arm.

According to one embodiment the actuating device is an electric motor or an actuator such as an electric actuator, a pneumatic actuator or a hydraulic actuator.

One embodiment comprises a lithium ion battery configured to drive at least one of the wheel motors. Alternatively, any other battery type with the corresponding capacity per volume unit may be used. The volume occupied by the battery may thereby be greatly reduced compared to traditional lead-acid batteries. This can greatly reduce the size and weight of the mobility device, and in particular enable movement of the rear wheel swing arm relative to the main frame as the centrally arranged traditional battery package can be discarded with. The battery/batteries of the present mobility device may also be arranged centrally in one example thereof; they may however be arranged in a dynamic member, such as the main frame.

One embodiment comprises a transversal linking mechanism connecting the drive wheel swing arms, wherein the transversal linking mechanism is configured to adjust the vertical position of the drive wheels so that a lowering of one of the drive wheels causes a corresponding elevation of the other one of the drive wheels, thereby enabling lateral tilting for stability.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
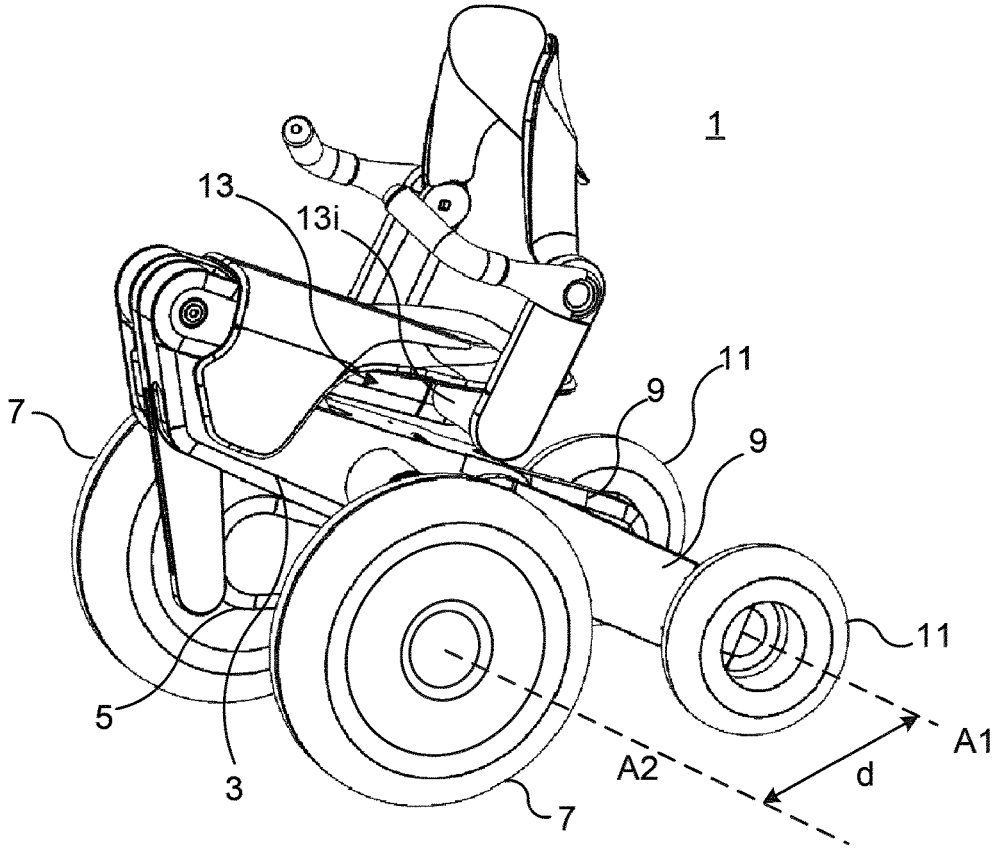
FIG. 1 schematically shows a perspective view of an example of a mobility device in one position thereof.

FIG. 1 shows a perspective view of an example of a mobility device 1. The mobility device 1 is shown in a first position. The mobility device 1 may be a mobility device for a disabled user. The mobility device 1 may be a mobility vehicle, and may in a sense be seen as a new type of wheelchair which replaces and/or complements existing types of wheelchairs.

The mobility device 1 comprises a main frame 3, drive wheel swing arms 5, of which only one is visible, drive wheels 7, rear wheel swing arms 9, rear wheels ii, and a body support system 13. The body support system 13 may be a body support assembly, body support structure or a body support.

The exemplified main frame 3 has an elongated shape. The main frame 3 is an essentially beam-like structure. The main frame 3 has a central longitudinal axis which coincides with the median plane of the mobility device 1.

The drive wheel swing arms 5 are pivotally connected to the main frame 3. Each drive wheel 7 is connected to a respective drive wheel swing arm 5. The mobility device 1 furthermore comprises wheel motors, not shown in FIG. 1. Each wheel motor is configured to drive a respective drive wheel 7. Each wheel motor may for example be incorporated in a respective wheel hub. The mobility device 1 also comprises a control system which is configured to control the wheel motors.

The rear wheel swing arms 9 are pivotally connected to the main frame 3. In the present example, the mobility device 1 comprises two identical rear wheel swing arms, but could alternatively comprise a single rear wheel swing arm with a single rear wheel connected to it or with two rear wheels connected to it. In an alternative with a single rear wheel swing arm, the two rear wheels may be pivotally connected to the rear wheel swing arm by means of a respective additional swing arm or a swing axle, to provide individual pivoting of each rear wheel. The operation of the rear wheel swing arm(s) as disclosed herein is however identical in all cases.

Figure 2:
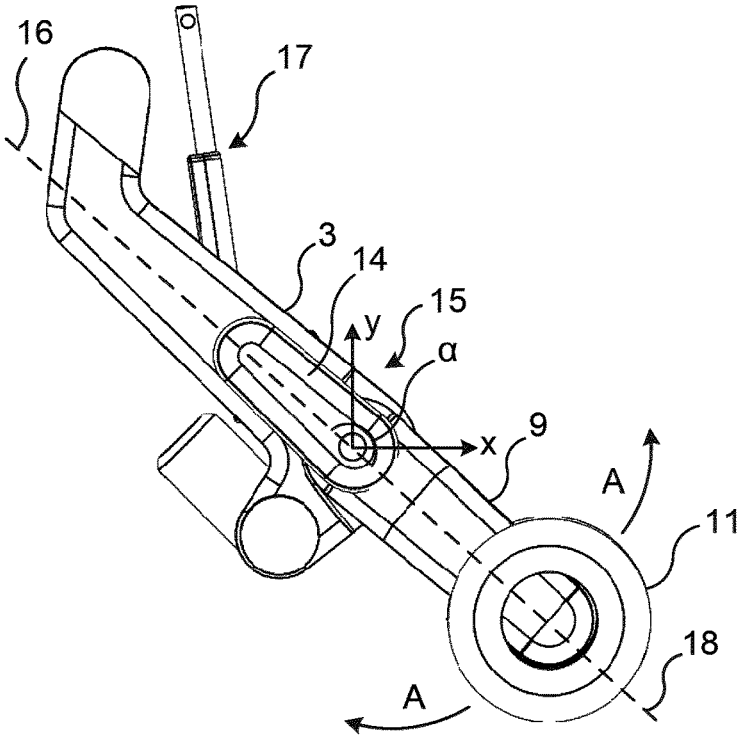
FIG. 2 schematically shows a side view of the main frame and a rear wheel swing arm of the mobility device in FIG. 1.

FIG. 2 shows a side view of the mobility device 1 with the body support system 13, the drive wheel swing arms 5, and the drive wheels removed for clarity. The main frame 3 has a somewhat different position than in FIG. 1.

The mobility device 1 comprises one or more batteries 14. The batteries 14 are configured to drive the mobility device 1, e.g. to drive the wheel motors, actuating device, and actuator disclosed herein. The one or more batteries 14 may for example be lithium batteries, but any other battery type with similar power/volume unit performance is suitable for this purpose.

The mobility device 1 comprises an actuating device 15. The actuating device 15 is in this example contained inside the main frame 3. The actuating device 15 is configured to control pivot motion of the rear wheel swing arms 9 relative to the main frame 3. The actuating device 15 is configured to independently control the pivot motion of the rear wheel swing arms 9. The actuating device 15 is hence dedicated to control the rear wheel swing arm 9 and its pivot motion/position. The actuating device 15 may for example comprise a servo motor, as in the example shown in FIG. 2, or a linear actuator or similar device.

The actuating device 15 is hence configured to control a pivot angle between the main frame 3 and the rear wheel swing arms 9. This pivot angle will in the following be referred to as the rear wheel swing arm angle $\alpha$. The rear wheel swing arm angle $\alpha$ can for example be defined as the angle between the longitudinal central axis 16 of the main frame 3 and a longitudinal central plane 18 of the rear swing arms 9 or as the orientation of the longitudinal central plane 18 in a reference coordinate system of the main frame 3 centred at the pivot axis between the main frame 3 and the rear wheel swing arm 9. In the example shown in FIG. 2, the rear wheel swing arm angle $\alpha$ is 180° based on the first definition given above. By changing the rear wheel swing arm angle $\alpha$, the distance d between the rear wheel drive axle A1 shown in FIG. 1 and the drive wheel axles A2, which in this example coincide, is adjusted or changed. The actuating device 15 may in particular be configured to pivot the rear wheel swing arms 9 in both directions from their central longitudinal axially aligned position shown in FIG. 2, as shown by arrows A, i.e. towards the positive x-axis and towards the negative y-axis, respectively, of the coordinate system shown in FIG. 2.

Control of the rear wheel swing arm angle $\alpha$ and hence positioning of the rear wheel swing arms 9 provides a first degree of freedom for centre of gravity control as well as for forward and rearward tilting.

The body support system 13 is pivotally connected to the main frame 3. The body support system 13 may be pivotally connected to the main frame 3 at a first end portion thereof in the longitudinal direction of the main frame 3. The rear wheel swing arms 9 may be connected to the main frame 3 at a second end portion thereof in the longitudinal direction of the main frame 3. In the present example, the main frame 3 has a curved first end portion. As another alternative, the main frame 3 could have an essentially straight extension between its two ends in the longitudinal direction.

Figure 3:
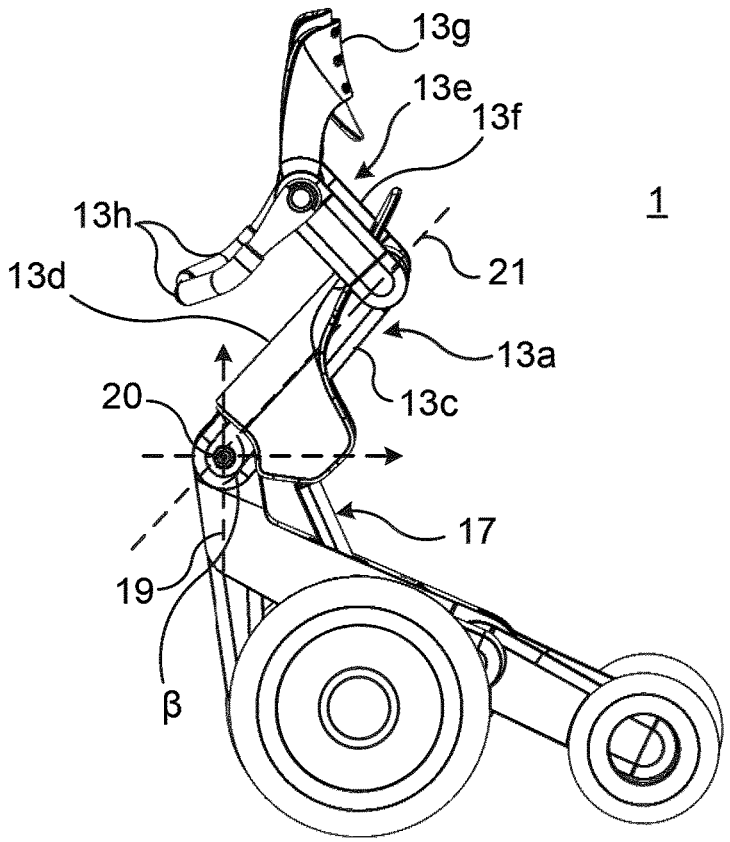
FIG. 3 schematically shows a perspective view of the mobility device in FIG. 1 in another position thereof.

Turning now to FIG. 3, another position of the mobility device 1 is shown. This position has relative to the one shown in FIG. 1 been obtained by changing the position of the body support system 13 relative to the main frame 3. To this end, the mobility device 1 may comprise an actuator 17. The actuator 17 is pivotally connected to the main frame 3 and to the body support system 13. The actuator 17 is configured to change a pivot angle between the main frame 3 and the body support system 13. This pivot angle will in the following be referred to as the body support system angle $\beta$. The body support system angle $\beta$ can for example be defined as the angle between the longitudinal central axis 19 of the first end portion of the main frame 3 extending through the pivot axis 20 of the pivot connection between the main frame 3 and the body support system 13, and the longitudinal central axis 21 of the structure/portion of the body support system which is pivotally connected to the main frame 3, or as the orientation of the longitudinal central axis 21 in a reference coordinate system of the main frame 3 centred at the pivot axis 20.

Control of the body support system angle $\beta$ provides a second degree of freedom for centre of gravity control as well as for forward and rearward tilting.

The exemplified body support system 13 comprises a lower body support system 13*a*. The lower body support system 13*a* may be a lower body support assembly, a lower body support structure or a lower body support. The lower body support system 13*a* has an elongated medial body support member 13*c* which forms the pivot connection with the main frame 3. The exemplified lower body support system 13*a* also comprises a seat 13*d*. The seat 13*d* may for example be a saddle seat, as shown in FIG. 3, or a regular seat. Furthermore, the lower body support system 13*a* may also include a transverse member 13*i*, shown in FIG. 1, connected transversely to the body support member 13*c* at a distal end thereof with respect to the pivot connection with the main frame 3. The body support member 13*c* and the transverse member 13*i* may have a T-shaped configuration, i.e. they may form the shape of a T. The body support member 13*c* may form the base of the T and the transverse member 13*i* may form the top of the T as seen in a top view.

The exemplified body support system 13 comprises an upper body support system 13*e*. The upper body support system 13*e* may be an upper body support assembly, an upper body support structure or an upper body support. The upper body support system 13*e* comprises lateral members 13*f* pivotally connected to the lower body support system 13*a*. In particular, the lateral members 13*f* may at a first end be connected to the transverse member 13*i* at a respective lateral end thereof. The upper body support system 13*e* also comprises a backrest 13*g* and arm rests 13*h* connected to the lateral members 13*f* at a second end of the lateral members 13*f*.

As an alternative to the above configuration, the lower body support system could instead be a lower body suspension system with the elongated medial body suspension member pivotally connected to the main frame. The lateral members can in this case be pivotally connected to the transverse member, but instead of extending vertically upwards from their pivot points, they extend vertically downwards from their pivot points. The seat is connected to the lateral members. The user would hence be suspended from the lower body suspension system in this case.

Figure 4:
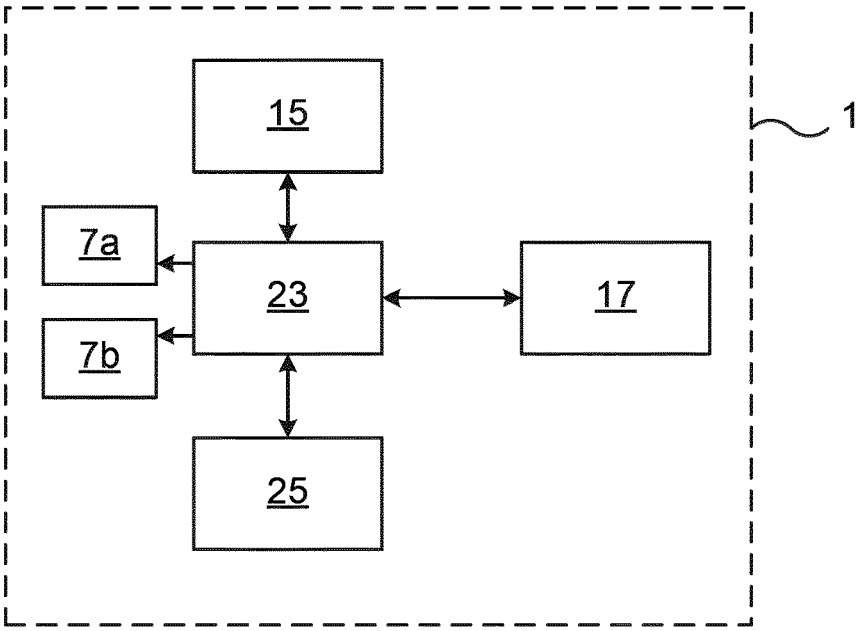
FIG. 4 shows a block diagram of a control system of the mobility device in FIG. 1.

The mobility device 1 furthermore comprises a control system 23, as shown schematically in the diagram in FIG. 4. Additionally, the mobility device 1 comprises inertial sensors 25. The control system 23 is configured to receive measurement data from the inertial sensors 25. The control system 23 is configured to control the actuating device 15 based on the measurements from the inertial sensors 25. The control system 23 is configured to control the actuator 17 based on the measurements from the inertial sensors 25.

The inertial sensors 25 may be configured to detect acceleration, deceleration, and orientation of the main frame 3. Hereto, the inertial sensors 25 may be arranged on or inside the main frame 3. The inertial sensors 25 may for example comprise an accelerometer and a gyroscope.

The mobility device 1 may be configured to determine the current rear wheel swing arm angle α. Hereto, the mobility device 1 may comprise a first position sensor configured to detect the position of the actuating device 15. The control system 23 may be configured to determine the rear wheel swing arm angle α based on the position of the actuating device 15, e.g. the rotor angle in case the actuating device 15 is a servo motor or the degree of extension in case the actuating device 15 is a linear actuator.

The mobility device 1 may also be configured to determine the current body support system angle β. Hereto, the mobility device 1 may comprise a second position sensor configured to detect the position of the actuator 17. The control system 23 may be configured to determine the body support system angle β based on the position of the actuator 17, e.g. the degree of extension in case the actuator 17 is a linear actuator.

The control system 23 stores all possible combinations of the rear wheel swing arm angle α and body support system angle β and the corresponding centre of gravity of the mobility device 1. In particular, the control system 23 comprises a storage medium which stores all of these combinations.

The control system 23 may furthermore be configured to control the wheel motors 7*a*. The control system 23 may be configured to control the wheel motors 7*a* based on the measurements from the inertial sensors 25 to provide immediate balance compensation in case the centre of gravity of the combination of the mobility device and the user suddenly shifts, requiring movement of the mobility device 1 to obtain stability.

In operation, the first position sensor provides first position data to the control system 23 about the position of the actuating device 15. The second position sensor provides second position data to the control system 23 about the position of the actuator 17. Based on the position of the actuating device 15 and the position of the actuator 17, the control system 23 is able to determine the centre of gravity of the mobility device 1 using the stored combinations in the storage medium, for example in the form of a data structure such as a table. Based on the first position data, the control system 23 may determine the rear wheel swing arm angle α. Furthermore, based on the second position data, the control system 23 may determine the body support system angle β. The control system 23 is configured to determine the centre of gravity of the mobility device 1 based on the rear wheel swing arm angle α and the body support system angle β using the combinations stored in the storage medium.

The control system 23 furthermore receives the measurements from the inertial sensors 25. Based on the centre of gravity of the mobility device 1 on its own, i.e. without a user, obtained as described above, and on the measurements, the centre of gravity of the combination of the mobility device 1 and the user may be obtained. The centre of gravity of the combination of the mobility device 1 and the user is the total centre of gravity of the user-loaded mobility device 1.

The control system 23 is configured to adjust the rear wheel swing arm angle α and/or the body support system angle β based on the centre of gravity of the combination of the mobility device 1 to obtain an adjusted centre of gravity of the combination of the mobility device 1 in case it is necessary for stability.

Thus as an example of operation, in case the mobility device 1 begins to tip over the drive wheels due to e.g. heavy breaking or forward-throwing of a user's torso, the inertial sensors 25 will detect this, and the control system 23 will be able to control the wheel motors 7*a* and 7*b* to counteract the tipping motion. The control system 23 may for example control the wheel motors 7*a*, 7*b* such that the mobility device 1 moves forward slightly, and simultaneously control the rear wheel swing arm angle α and/or the body support system angle β to obtain an adjusted centre of gravity of the combination of the mobility device 1 and the user which is safer.

In general, when the centre of gravity of the combination of the mobility device 1 and the user is moved forward, the distance d between the rear wheel drive axle A1, shown in FIG. 1, and the drive wheel axles A2 is shortened. When the centre of gravity of the combination of the mobility device 1 and the user is moved rearwards, the distance d between the rear wheel drive axle Aland the drive wheel axles A2 is extended.

The mobility device 1 may also comprise a user interface which allows the user to control the rear wheel swing arm angle α and the body support system angle β within safe boundaries with respect to the centre of gravity, to allow for example tilting as desired. Forward and rearward, i.e. anterior and posterior tilting may be obtained. The user interface is electrically connected to the control system 23, and the control system 23 is configured to receive user input from the user interface so that based on the user input, the current position of the actuating device 15, the current position of the actuator 17 and the measurements by the inertial sensors 25, the control system 23 may control the rear wheel swing arm angle α and the body support system angle β to a safe user-initiated position.

Figure 5A:
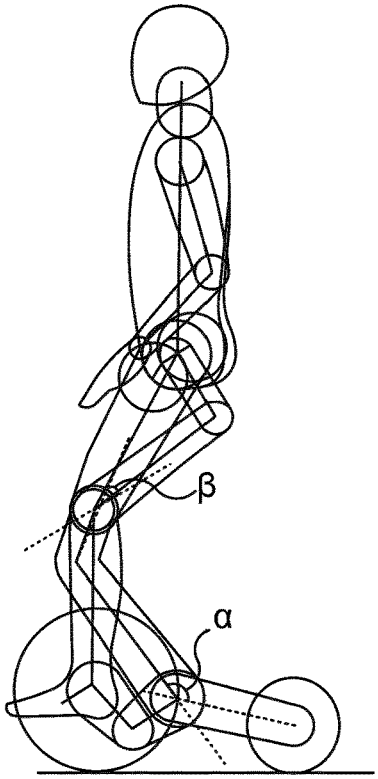
FIGS. 5*a*-5*d* schematically show examples of various positions that the mobility device in FIG. 1 can obtain.

Various possible configurations of the position of the mobility device 1 with a mobility device user on board are shown in FIGS. 5*a*-5*d*. In FIG. 5*a*, the rear wheel swing arm angle α and the body support system angle β have been set by the control system 23 to obtain full standing tilt.

Figure 5B:
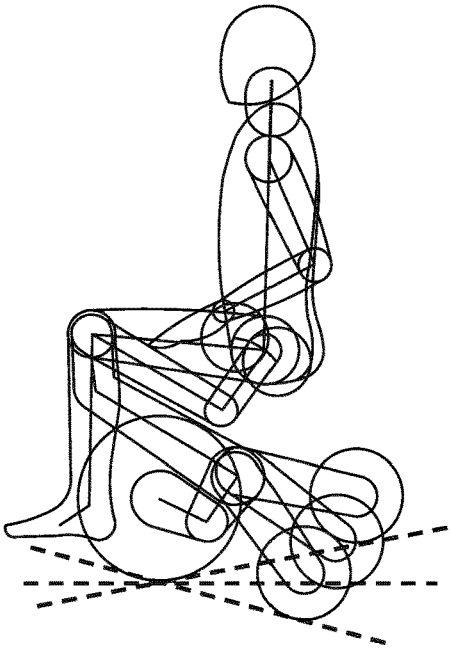

FIG. 5*b* shows the mobility device 1 maneuvering an uneven surface. In this example, the rear wheel swing arm angle α is adjusted dynamically as the mobility device 1 moves forward and the ground surface changes.

Figure 5C:
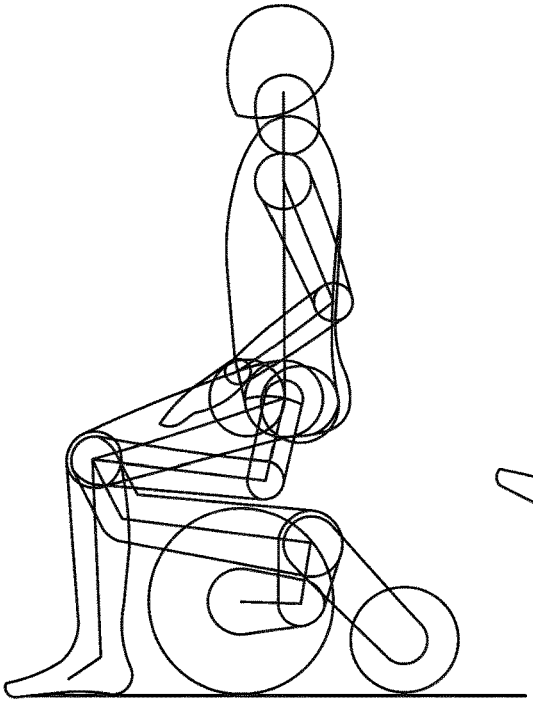
Figure 5D:
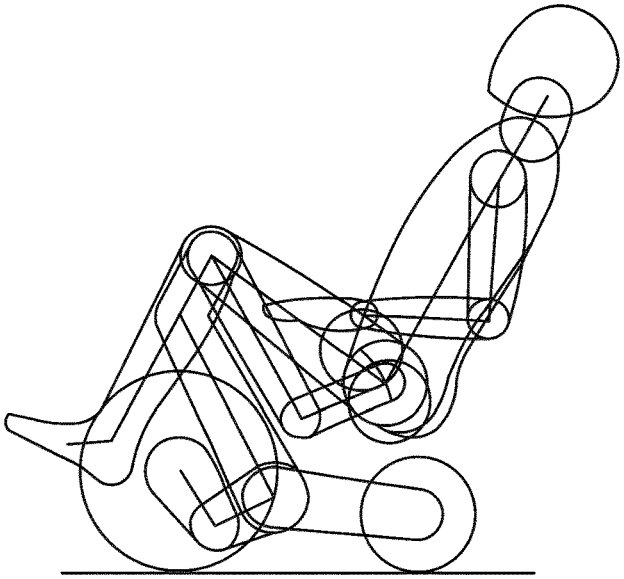

FIG. 5*c* shows the shortening of the distance d due to the centre of gravity of the combination of the mobility device 1 and the user being moved forward. FIG. 5*d* shows the extension of the distance d due to the centre of gravity of the combination of the mobility device 1 and the user being moved rearwards.

Figure 6:
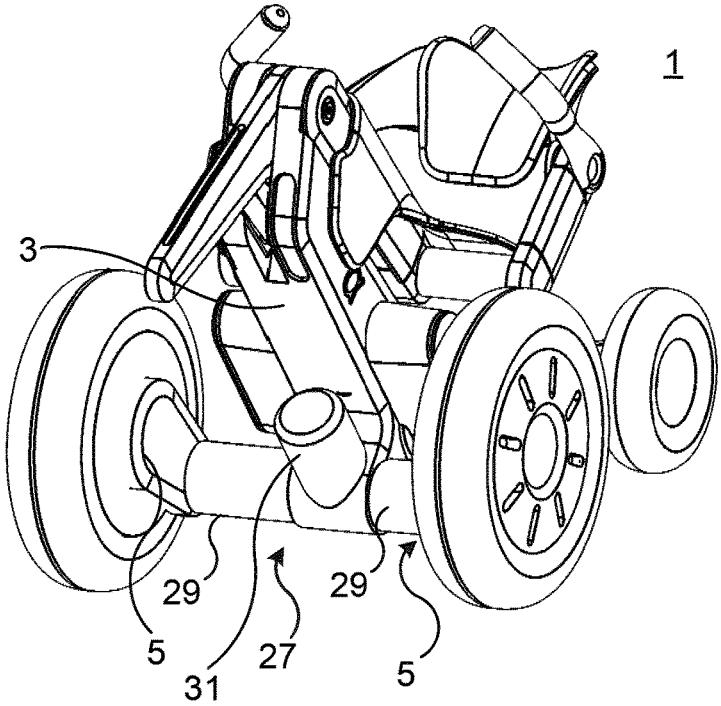
FIG. 6 shows a perspective view of the mobility device in yet another position.

FIG. 6 depicts a posterior tilt position of the mobility device 1. As shown, the mobility device 1 may comprise a lateral balancing assembly 27. The mobility device 1 could alternatively be provided without the lateral balancing assembly 27.

The lateral balancing assembly 27 may form part of the main frame 3. The drive wheel swing arms 5 may be pivotally connected to the lateral balancing assembly 27. The lateral balancing assembly 27 is configured to provide lateral stability compensation such that in case of one of the drive wheel swing arms 5 is pivoted to vertically elevate e.g. due to one drive wheel moving onto an elevated surface which is not present under the other drive wheel, the other drive wheel swing arm 5 is pivoted to a vertically lowered position with the corresponding amount. This provides lateral stability for example if driving along a slanting surface.

The exemplified lateral balancing assembly 27 comprises lateral distancing elements 29 extending in opposite lateral directions from the main body of the main frame 3. Each drive wheel swing arm 5 is fixedly mounted to a respective lateral distancing element 29. The lateral balancing assembly 27 furthermore comprises a medial default position device, which in this example extends centrally from the main body of the main frame 3.

Figure 7:
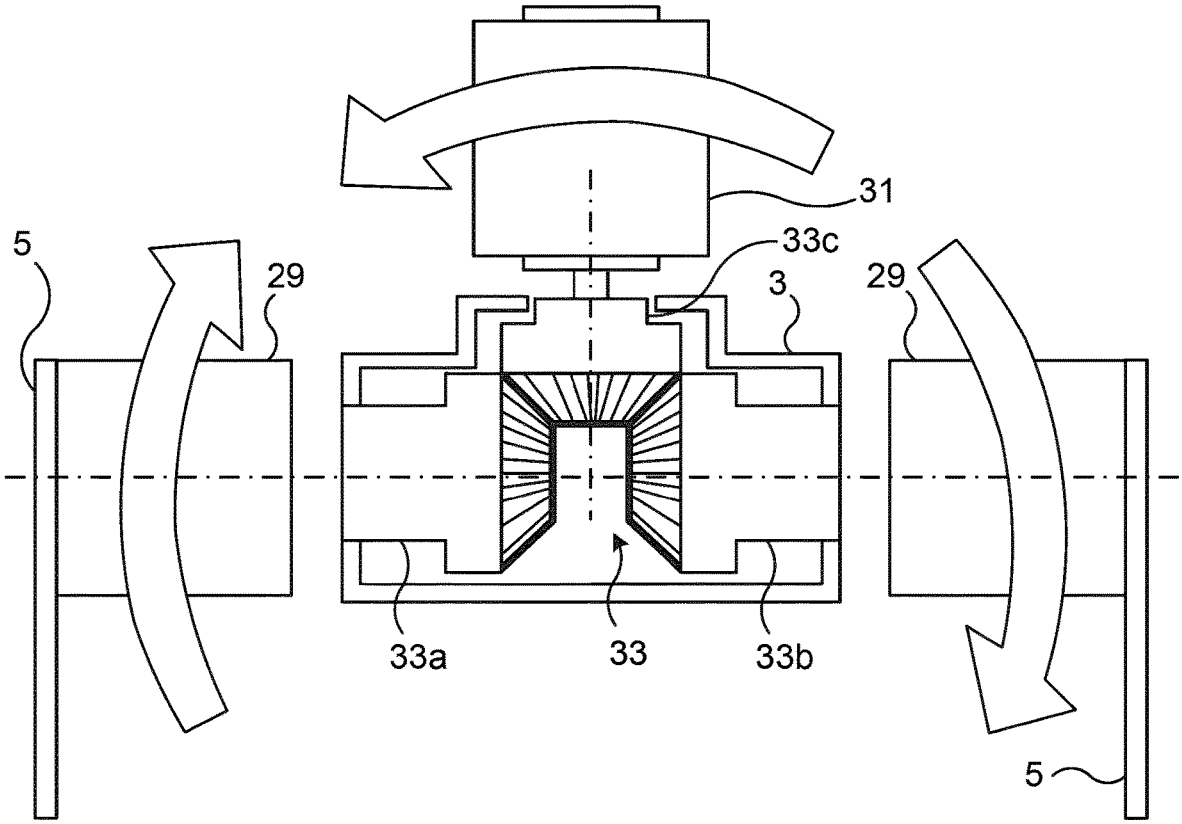
FIG. 7 shows a section of a lateral balancing assembly of the mobility device shown in FIG. 6.

FIG. 7 shows a section of the lateral balancing assembly 27, schematically exposing the interior thereof. The lateral balancing assembly 27 comprises a transversal linking mechanism 33, which connects the drive wheel swing arms 5. The transversal linking mechanism 33 is configured to perform the previously-mentioned lateral compensation of movement of the two opposing drive wheel swing arms 5. The transversal linking mechanism 33 is in this example contained in the main frame 3.

The transversal linking mechanism 33 comprises a gear assembly including three pinions 33*a*-33*c*. Two of the pinions are lateral pinions 33*a*, and the third of the pinions is a medial pinion 33*c*. The three pinions 33*a*-33*c* are arranged in a differential type of configuration. Hereto, the medial pinion 33*c* rotatably connects the two lateral pinions 33*a* and 33*b* so that pivoting motion in a first direction of one of the drive wheel swing arms 5 is transferred to the other drive wheel swing arm 5 via the medial pinion 33*c* so that it performs a pivoting motion in a second direction opposite to the first direction.

Each lateral distancing element 29 is fixedly connected to a respective lateral pinion 33*a* and 33*b*. Each lateral distancing element 29 may according to one example comprise a torsion control device such as a torsion biasing device, e.g. a torsion spring, which biases the distancing lateral element 29 to a default rotational position. In the default rotational position both drive wheel swing arms 5 have the same position, as shown in for example FIG. 1.

Alternatively, the lateral distancing elements 29 may be without torsion springs.

The medial default position device 31 is fixedly connected to the medial pinion 33*c*. The medial default position device 31 comprises a torsion control device such as a servo motor or a torsion biasing device, e.g. a torsion spring to urge or bias the medial pinion 33*c* into a default position.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A mobility device (1) comprising:

a main frame (3), drive wheel swing arms (5) pivotally connected to the main frame (3), drive wheels (7) connected to a respective one of the drive wheel swing arms (5), wheel motors (7*a*, 7*b*), each wheel motor (7*a*, 7*b*) being configured to drive a respective drive wheel (7), a rear wheel swing arm (9) pivotally connected to the main frame (3), a rear wheel (11) connected to the rear wheel swing arm (9), and an actuating device (15) configured to control a rear wheel swing arm angle (α) between the rear wheel swing arm (9) and the main frame (3) independently of control of the wheel motors (7*a*, 7*b*), the mobility device (1) further comprising:

a body support system (13) configured to support the body of a user and being pivotally connected to the main frame (3), wherein the body support system (13) includes a lower body support system (13*a*), and wherein the body support system (13) comprises an upper body support system (13*d*) pivotally connected to the lower body support system (13*a*).

2. The mobility device (1) as claimed in claim 1, wherein the actuating device (15) is configured to adjust the rear wheel swing arm angle (α) by pivoting the rear wheel swing arm (9) relative to the main frame (3), thereby adjusting a distance d between a rear wheel axle of the rear wheel (11) and drive wheel axles of the drive wheels (7).

3. The mobility device as claimed in claim 1, comprising an actuator (17) pivotally connected to the body support system (13) and pivotally connected to the main frame (3), wherein the actuator (17) is configured to control a body support system angle (β) between the main frame (3) and the body support system (13).

4. The mobility device (1) as claimed in claim 3, wherein the actuator (17) is configured to adjust the body support system angle (β) by pivoting the body support system (13) relative to the main frame (3).

5. The mobility device (1) as claimed in claim 4, further comprising inertial sensors (25) and a control system (23), wherein the control system (23) is configured to control the actuating device (15) and thereby the rear wheel swing arm angle (α) based on measurements by the inertial sensors (25).

6. The mobility device (1) as claimed in claim 5, wherein the control system (23) is configured to control the actuator (17) to adjust the body support system angle (β) based on the measurements by the inertial sensors (25).

7. The mobility device (1) as claimed in claim 6, wherein the control system (23) is configured to determine a current rear wheel swing arm angle (α) and a current body support system angle (β), and to obtain a corresponding centre of gravity of the mobility device (1), and wherein the control system (23) is configured to determine the centre of gravity of the combination of the mobility device (1) and the mobility device user based on the centre of gravity of the mobility device (1) and on the measurements by the inertial sensors (25), and to adjust the rear wheel swing arm angle (α) and/or the body support system angle (β) based on the centre of gravity of the combination of the mobility device and a mobility device user to obtain an adjusted centre of gravity of the combination of the mobility device (1) and the mobility device user for stability.

8. The mobility device (1) as claimed in claim 7, wherein the control system (23) stores all possible combinations of the rear wheel swing arm angle (α) and the body support system angle (β) and the corresponding centre of gravity of the mobility device (1).

9. The mobility device (1) as claimed in claim 1, wherein the main frame (3) is an elongated structure.

10. The mobility device (1) as claimed in claim 9, wherein the main frame (3) has a first end portion to which the body support system (13) is pivotally connected to the main frame (3) and a second end portion to which the rear wheel swing arm (9) is pivotally connected to the main frame (3).

11. The mobility device (1) as claimed in claim 1, wherein the drive wheels (7) are front wheels and wherein the drive wheel swing arms (5) are front swing arms.

12. The mobility device (1) as claimed in claim 1, further comprising a lithium ion battery configured to drive at least one of the wheel motors (7*a*, 7*b*).

13. The mobility device (1) as claimed in claim 1, further comprising a transversal linking mechanism (33) connecting the drive wheel swing arms (5), wherein the transversal linking mechanism (33) is configured to adjust the vertical position of the drive wheels (5) so that a lowering of one of the drive wheels (5) causes a corresponding elevation of the other one of the drive wheels (5), thereby enabling lateral tilting for stability.

14. The mobility device (1) as claimed in claim 1, further comprising inertial sensors (25) and a control system (23), wherein the control system (23) is configured to control the actuating device (15) and thereby the rear wheel swing arm angle ($\alpha$) based on measurements by the inertial sensors (25).

15. The mobility device (1) as claimed in claim 1, wherein the drive wheel swing arms (5) being pivotally connected to the main frame (3) at a first position to define a first pivot axis; the body support system (13) being pivotally connected to the main frame (3) at a second position to define a second pivot axis different from the first pivot axis.

16. The mobility device (1) as claimed in claim 1, wherein the lower body support system (13*a*) is pivotally connected to the main frame (3).

17. The mobility device (1) as claimed in claim 1, wherein the body support system (13) is pivotally connected to the main frame (3) at a first pivot axis (20), and the rear wheel swing arm (9) is pivotally connected to the main frame (3) at a second pivot axis different from the first pivot axis (20).

18. A mobility device (1) comprising:

an elongated main frame (3) configured to coincide with a median plane of the mobility device (1), drive wheel swing arms (5) pivotally connected to the main frame (3), drive wheels (7) connected to a respective one of the drive wheel swing arms (5), wheel motors (7*a*, 7*b*), each wheel motor (7*a*, 7*b*) being configured to drive a respective drive wheel (7), a rear wheel swing arm (9) pivotally connected to the main frame (3), a rear wheel (11) connected to the rear wheel swing arm (9), and an actuating device (15) configured to control a rear wheel swing arm angle ($\alpha$) between the rear wheel swing arm (9) and the main frame (3) independently of control of the wheel motors (7*a*, 7*b*), the mobility device (1) further comprising:

a body support system (13) configured to support the body of a user and being pivotally connected to the main frame (3), wherein the body support system (13) includes a lower body support system (13*a*) pivotally connected to the main frame (3), and wherein the body support system (13) comprises an upper body support system (13*d*) pivotally connected to the lower body support system (13*a*).

19. The mobility device (1) as claimed in claim 18, wherein the drive wheel swing arms (5) being pivotally connected to the main frame (3) to define a first pivot axis, and the body support system (13) being pivotally connected to the main frame (3) to define a second pivot axis different from the first pivot axis.

20. The mobility device (1) as claimed in claim 19, wherein the first pivot axis is positioned at a first end of the main frame (3) and the second pivot axis is positioned at a second end of the main frame (3).

* * * * *